US011712918B2

(12) United States Patent
Corey

(10) Patent No.: US 11,712,918 B2
(45) Date of Patent: Aug. 1, 2023

(54) EXPANSION PAPER BOARD FOLDER WITH MOLDED GUSSET

(71) Applicant: Thomas J. Corey, Snyder, NY (US)

(72) Inventor: Thomas J. Corey, Snyder, NY (US)

( * ) Notice: Subject to any disclaimer, the term of this patent is extended or adjusted under 35 U.S.C. 154(b) by 323 days.

(21) Appl. No.: 17/308,112

(22) Filed: May 5, 2021

(65) Prior Publication Data

US 2022/0355611 A1 Nov. 10, 2022

(51) Int. Cl.
*B42F 7/08* (2006.01)

(52) U.S. Cl.
CPC ..... *B42F 7/08* (2013.01); *B42P 2241/02* (2013.01)

(58) Field of Classification Search
CPC ..... B42F 7/08; B42P 2241/02
USPC ..... 229/67.3
See application file for complete search history.

(56) References Cited

U.S. PATENT DOCUMENTS 282,275 A * 7/1883 Cooke, Jr. ..... B42F 17/02 229/72
510,350 A * 12/1893 Lochman ..... B42F 17/02 229/72
1,698,841 A * 1/1929 Doughty ..... B42F 7/08 229/72
1,745,249 A * 1/1930 Doughty ..... B42F 7/08 383/33
2,772,427 A * 12/1956 Rankin ..... B42F 13/0066 402/75
3,008,248 A * 11/1961 Steinthal ..... G09F 5/04 402/19
4,284,227 A * 8/1981 Corey ..... B42D 3/00 229/67.3
4,762,341 A * 8/1988 Rabuse ..... B42D 3/002 412/8
5,025,979 A * 6/1991 Dellacroce ..... B42F 15/0035 281/31
5,161,731 A 11/1992 Rivlin et al.
5,236,226 A * 8/1993 Sheffield ..... B42F 7/02 281/31
5,720,427 A * 2/1998 Kachel ..... B42F 7/08 229/67.3
5,893,585 A * 4/1999 Worthen ..... B42D 3/00 281/29
6,047,879 A 4/2000 Henrikson et al.
6,139,063 A 10/2000 Purcocks
7,264,119 B2 9/2007 Navickas
(Continued)

FOREIGN PATENT DOCUMENTS

CN 201052713 Y 2/2007
CN 104723732 A 6/2015
(Continued)

*Primary Examiner* — Peter N Helvey
(74) *Attorney, Agent, or Firm* — Simpson & Simpson, PLLC

(57) ABSTRACT

An expansion folder with internal dividers with an accordion-pleated spline, comprising, a front cover, the front cover comprising an outwardly facing surface and an inwardly facing surface, a rear cover, the rear cover comprising an outwardly facing surface and an inwardly facing surface, a plurality of dividers, each of the plurality of dividers comprising a front-facing surface and a rear-facing surface, and, an accordion-pleated spline, the spline comprising a polymer formed into a plurality of pleats, the pleats further comprising an alternating series of "M-shaped" and "W-shaped" pleats.

17 Claims, 6 Drawing Sheets

(56) References Cited

U.S. PATENT DOCUMENTS

| | | | | |
|---|---|---|---|---|
| 8,104,669 | B2 * | 1/2012 | Christensen | B31B 50/26 281/23 |
| 9,352,605 | B1 | 5/2016 | Corey | |
| 9,630,441 | B1 * | 4/2017 | King | B42D 3/002 |
| 10,131,468 | B2 | 11/2018 | Ishihara et al. | |
| 2008/0223907 | A1 | 9/2008 | Su | |
| 2009/0084832 | A1 * | 4/2009 | Hsieh | A45C 13/10 229/67.4 |
| 2012/0111930 | A1 | 5/2012 | Maistrellis | |
| 2022/0355611 | A1 * | 11/2022 | Corey | B42F 7/08 |

FOREIGN PATENT DOCUMENTS

| | | | |
|---|---|---|---|
| FR | 2906497 | A1 | 4/2008 |
| WO | 9303933 | A1 | 3/1993 |

* cited by examiner

EXPANSION PAPER BOARD FOLDER WITH MOLDED GUSSET

FIELD OF THE INVENTION

The present invention relates generally to an expansion folder, more particularly to an expansion folder having a pleated spline having a specific pleat configuration and dividers affixed thereto.

BACKGROUND OF THE INVENTION

Expansion folders are well known in the art. The first paperboard expansion folders and dividers were made with a book-binding cloth known as cambric cloth—an adhesive coated coat cloth used as a tape to hold a form and to pleat an accordion-folded gusset. In the 1980s, manufacturers substituted DuPont® Tyvek® material for the tape membrane to decrease material costs, but it did not necessarily provide an advancement in the art field.

Expansion folders normally comprise some variation of a folded or pleated spline that affords expansion of the entire folder to accommodate increasing quantities of files being stored therein. Over time, the expanded spline loses durability and is susceptible to fraying, delamination, and/or curling of front covers, back covers, internal dividers, and the pleated spline. Various attempts to solve these problems have been contemplated and employed.

For example, U.S. Pat. No. 4,284,227 discloses an expansion folder that includes an accordion-pleat backbone that is fabricated in such a manner so that will not become limp and will always fold inwardly between two covers that are affixed thereto. The accordion-pleat backbone also includes a reinforcing arrangement that maintains the backbone in a strengthened condition while not interfering with the folding action of the backbone. The reinforcing arrangement is more specifically defined as a tape-like material that is arranged to cover the entire surface of the accordion-pleat backbone. When the tape-like material is applied to the backbone, a plurality of slots function as hinges between the backbone and the respective covers.

Another example is shown in U.S. Pat. No. 8,104,669, which discloses a strengthened folder with inserted elements, namely a pocket or divider, allowing for interchangeability and variable uses of the strengthened folder. The folder comprises a front cover and a back cover secured to an accordion spline. The accordion spline is a material that is formed into a series of zigzags that are substantially "W-shaped" folds that further include peaks and valleys. The accordion spline further comprises a web outer material which secures to an outside surface of the front cover and an outside surface of the back cover on an inside surface of the outer web at respective terminating ends of the accordion spline. An interior web material is secured to the inside surface of the front cover and the inside surface of the back cover, effectively sandwiching the front cover and the back cover in-between the outer web and the inner webs. The same sandwiching means secure a divider/insert and/or pocket to the accordion spline.

Thus, there is a long-felt need for an expansion folder having a strengthened accordion-like spline that is comprised of a polymer to reduce the overall size, improve strength, and provide water/moisture resistance to prevent long-term deterioration that is further arranged to include pleats having both a "W-shaped" and an "M-shaped" configuration that is still further arranged to include internal dividers while providing an increased expanded capacity.

SUMMARY OF THE INVENTION

The present invention broadly comprises an expansion folder with internal dividers, the folder having an accordion-pleated spline, the folder comprising a front cover, the front cover comprising an outwardly facing surface and an inwardly facing surface, a rear cover, the rear cover comprising an outwardly facing surface and an inwardly facing surface, a plurality of dividers, each of the plurality of dividers comprising a front-facing surface and a rear-facing surface, and, an accordion-pleated spline, the spline comprising a polymer formed into a plurality of pleats, the pleats further comprising an alternating series of "M-shaped" and "W-shaped" pleats, wherein a single internal surface of one of the M-shaped pleats is fixedly secured to the outwardly facing surface of the front cover, a single internal surface and a single external surface of one of the W-shaped pleat is fixedly secured to the inwardly facing surface of the rear cover and the outwardly facing surface of the rear cover, respectively, and one and only one internal surface of one of the M-shaped pleats or one and only one external surface of the W-shaped pleats is secured to either the front-facing surface or the rear-facing surface of one of each of the plurality of dividers.

An object of the invention is to provide an expansion folder with internal dividers with an accordion-pleated spline, comprising, a front cover, the front cover comprising an outwardly facing surface and an inwardly facing surface, a rear cover, the rear cover comprising an outwardly facing surface and an inwardly facing surface, a plurality of dividers, each of the plurality of dividers comprising a front-facing surface and a rear-facing surface, an accordion-pleated spline, the spline comprising a polymer formed into a plurality of pleats, the pleats further comprising an alternating series of "M-shaped" and "W-shaped" pleats, wherein a single internal surface of one of the M-shaped pleats is fixedly secured to the outwardly facing surface of the front cover, a single internal surface and a single external surface of one of the W-shaped pleat is fixedly secured to the inwardly facing surface of the rear cover and the outwardly facing surface of the rear cover, respectively, and one and only one internal surface of one of the M-shaped pleats or one and only one external surface of the W-shaped pleats is secured to either the front-facing surface or the rear-facing surface of one of each of the plurality of dividers, and, at least one fastener arranged to clamp said outwardly facing surface of said front cover and said outwardly facing surface of said rear cover.

A further object of the invention is to provide an expansion folder with internal dividers with an accordion-pleated spline further arranged to configure into a closed position and an open position, wherein a width of the open position of the expansion folder is approximately 2465% greater than a width of the closed position of the expansion folder.

Another object of the invention is to provide an expansion folder with internal dividers with an accordion-pleated spline having a front cover, a rear cover, and a plurality of dividers, where the front cover and the rear cover is comprised of solid paperboard, and each of the plurality of dividers is comprised of 17 pt hardwood natural Kraft paper. (Note: Kraft paper and the Kraft process is defined here: https://en.wikipedia.org/wiki/Kraft_paper, last accessed on May 3, 2021.)

A further object of the invention is to provide an expansion folder with internal dividers with an accordion-pleated spline having a front cover, a rear cover, and a plurality of dividers, where each of plurality of dividers have two externally facing surfaces, each of the plurality of dividers may include a fastener, the fastener comprises a body and a pair of prongs extending therefrom, wherein the body of the fastener is heat embedded within each of the plurality of dividers and the prongs extend from one of the outer surfaces of each of the plurality of dividers.

These and other objects, features and advantages of the invention will become readily apparent to one having ordinary skill in the art upon study of the following detailed description in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE PREFERRED EMBODIMENT

At the outset, it should be appreciated that like reference numbers on different drawing figures represent identical structural elements. It should also be appreciated that, while a number of different embodiments and variations of the present invention are shown in the various drawings, the invention as claimed is not intended to be limited to these specific embodiments, as the claims define a broader invention that can take many different shapes and structures. Also, the adjectives, "top", "bottom", "right", "left", and their derivatives, in the description herebelow, refer to the perspective of one facing the invention as shown in the figure under discussion.

Figure 1:
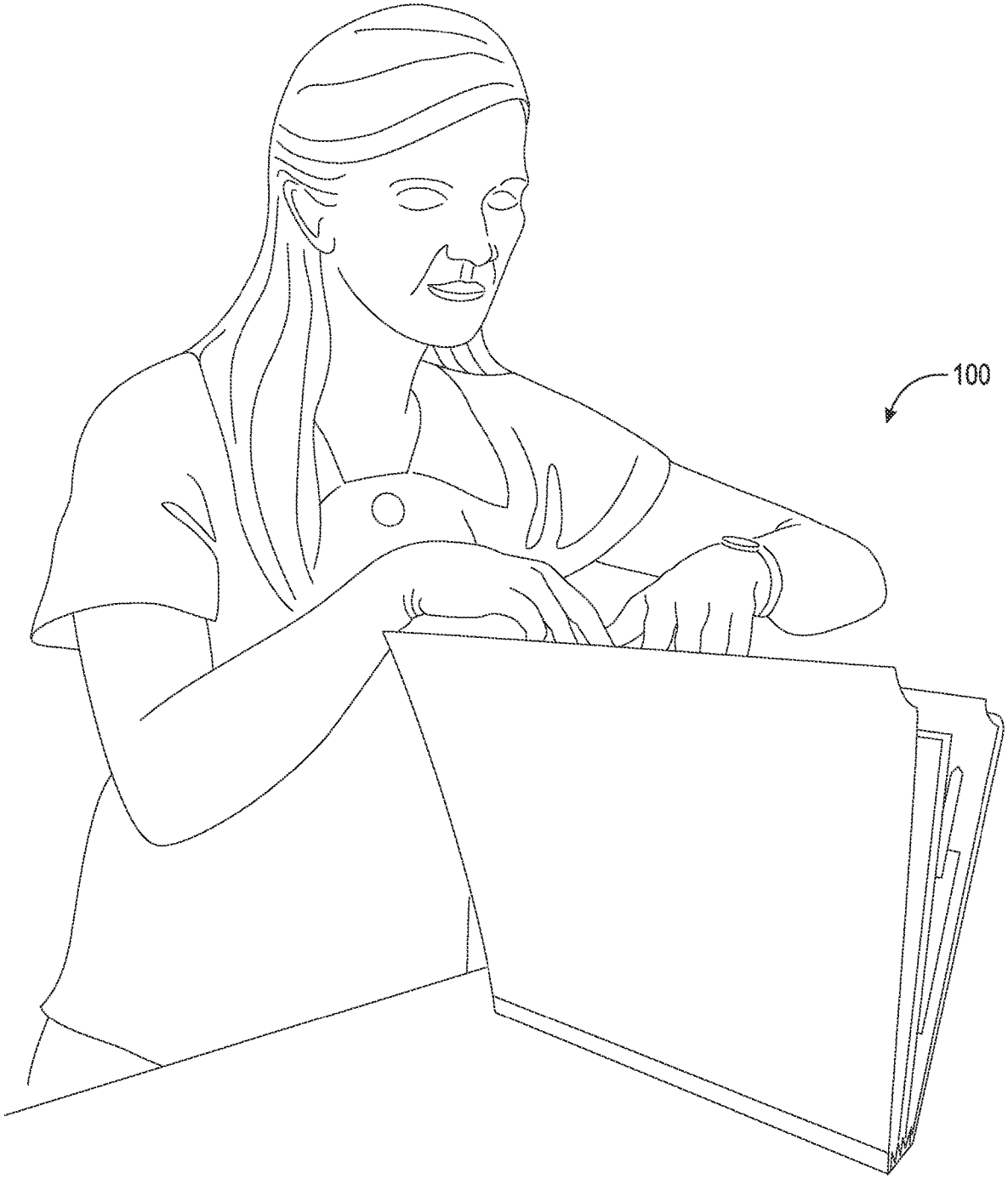
FIG. 1 illustrates a perspective view of the present invention in use.

Adverting now to the drawings, FIG. 1 illustrates a perspective view of expansion folder 100 in use. Expansion folder 100 is an expansion paper board folder that comprises a molded gusset. Notably, folder 100 has an accordion pleated spline that is folded to have alternating "W-shaped" and "M-shaped" pleats, discussed in further detail infra. Folder 100 also comprises a plurality of inner dividers that may include a bracket that is arranged to accept and hold a plurality of paper documents.

Figure 2:
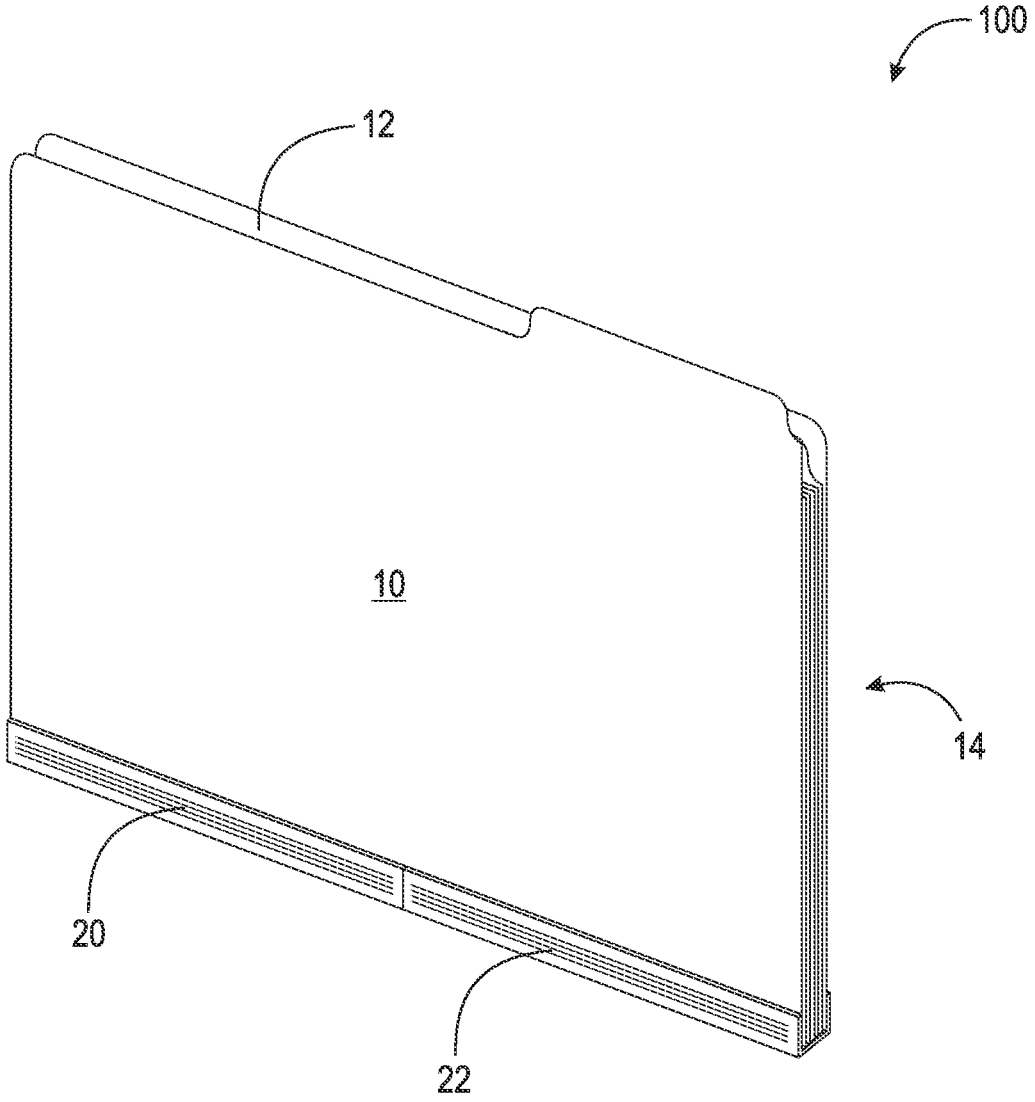
FIG. 2 illustrates a perspective view of the present invention shown in FIG. 1.

FIG. 2 illustrates a perspective view of expansion folder 100 that is in a closed position. Expansion folder 100 comprises front cover 10 and rear cover 12 which are fixedly secured to an accordion-pleated spline. Between front cover 10 and rear cover 12 are plurality of inner dividers 14. Plurality of inner dividers 14 are also fixedly secured to the accordion-pleated spline. In a closed position the accordion-pleated spline of expansion folder 100 is arranged to accept two brackets that secure expansion folder in a closed positioned. In the exemplary embodiment shown in FIG. 2, first bracket 20 and second bracket 22 are shown engaged to the accordion-pleated spline of expansion folder 100, although it should be appreciated that there may only need to be one bracket to keep expansion folder 100 in a closed position. Alternatively, smaller brackets in greater quantities may also be used, such as three brackets engaged to the accordion-pleated spline of expansion folder 100. The quantity of brackets that are needed to secure expansion folder 100 in a closed position depends on the size of paper documents that are intended to be stored within folder 100. For example, a larger-sized folder 100 may be used for A4 sized documents and may need more than a pair of brackets.

Figure 3:
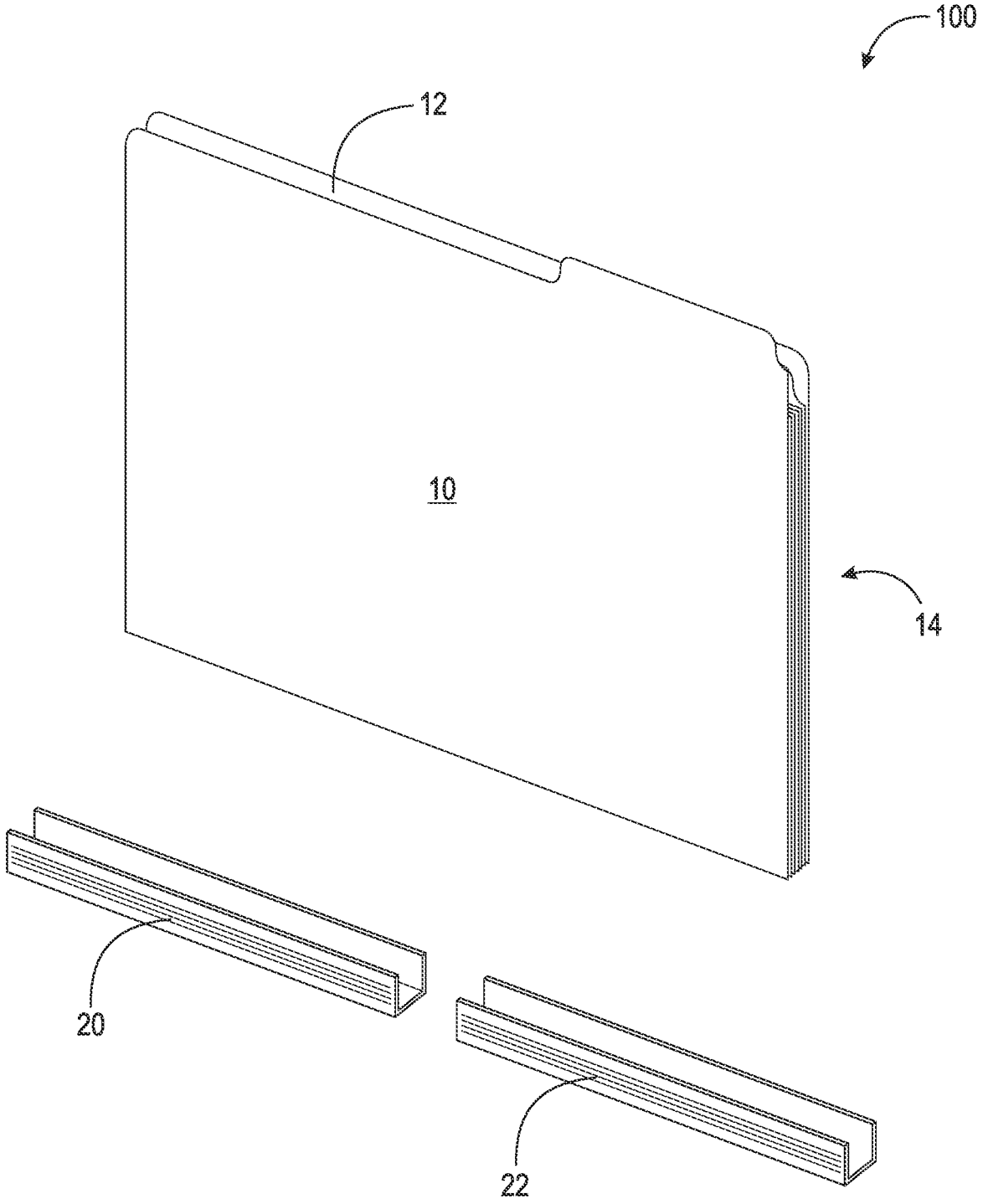
FIG. 3 illustrates a perspective view of the present invention shown in FIG. 2 where the spline brackets are removed from the expansion folder.

FIG. 3 illustrates a perspective view of expansion folder 100 that is in a closed position with first bracket 20 and second bracket 22 removed from the accordion-pleated spline. First bracket 20 and second bracket 22 are frictionally secured to the outer surface of front cover 10, the outer surface of rear cover 12, the outer surface of the accordion-pleated spline, and the outer surface of the valleys of the accordion-pleated spline. To open expansion folder 100 for use, first bracket 20 and second bracket 22 are simply pulled off expansion folder 100 from their engaged positions as shown in FIG. 2.

Figure 4:
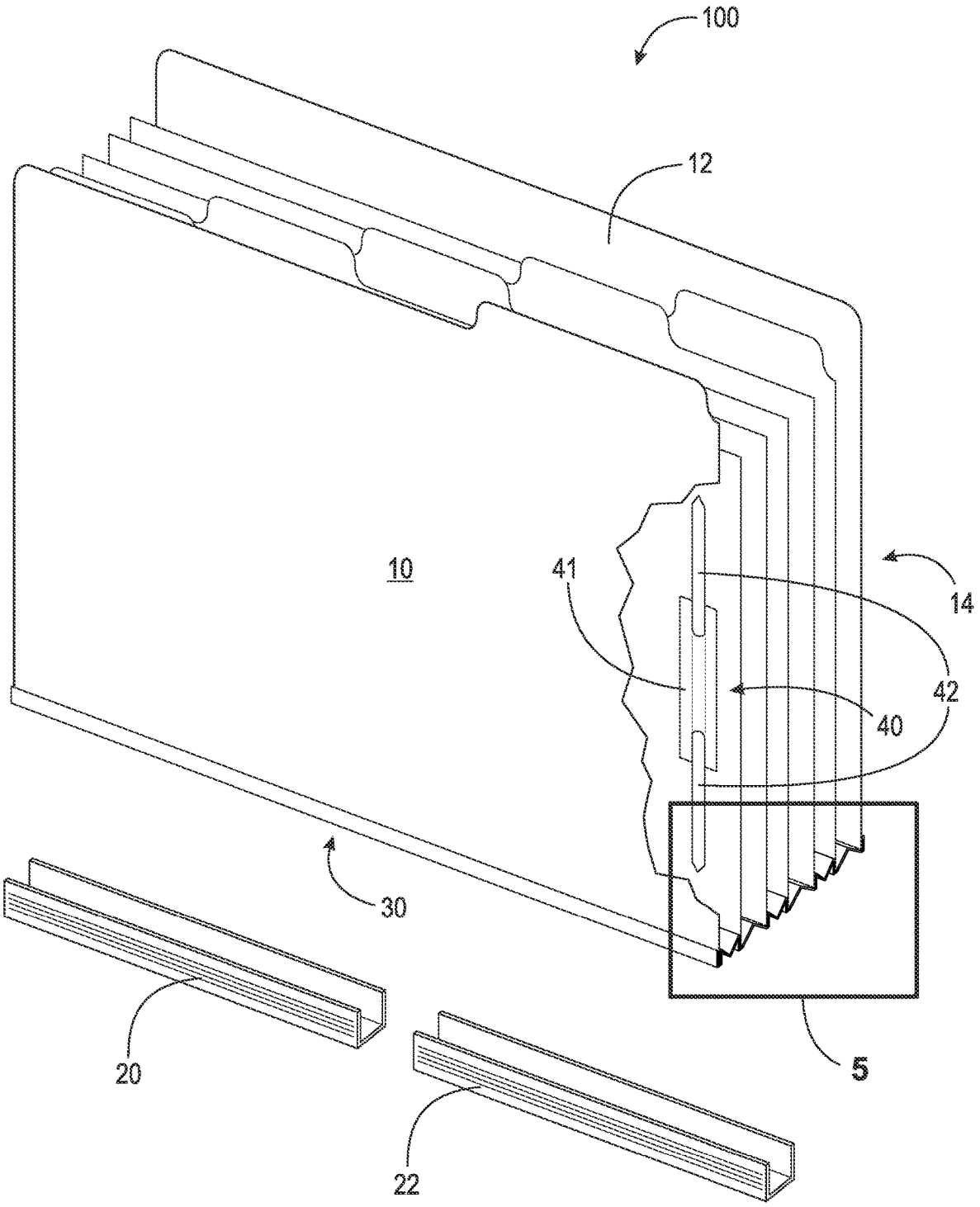
FIG. 4 illustrates a perspective of the present invention in shown in FIG. 3 in an open position where the spline brackets are removed and the front cover is partially cut-away to reveal the inner dividers of the expansion folder.

FIG. 4 illustrates a perspective of expansion folder 100 in an open position where first bracket 20 and second bracket 22 are removed. Additionally, FIG. 4 illustrates a partially cut-away view of front cover 10 to reveal plurality of internal dividers 14 and fastener 40. Fastener 40 is fixed to an external surface of one of the internal dividers or alternatively may be embedded within one of the internal dividers. Accordion-pleated spline 30 is shown at the bottom of expansion folder 100. Accordion-pleated spline 30 is arranged to hold front cover 10, rear cover 12 and plurality of inner dividers 14, which are all fixedly secured to an inner surface of spline 30. Spline 30 further allows expansion folder 100 to expand and contract to either decrease or increase in size to accommodate a plurality of paper documents that are arranged to be stored between front cover 10 and rear cover 12, and/or within plurality of inner dividers 14.

Fastener 40 in the exemplary embodiment in FIG. 4 has main body 41 and pair of prongs 42, where body 40 is fixedly secured to one, or all, of each divider of plurality of internal dividers 40. Prongs 42 of fastener 40 are of a deformable construction such that they may be hand-manipulated in order to secure paper files through an aperture created by a hole-punch, as commonly known in the art. Fastener 40 is shown in the exemplary embodiment in FIG. 4 to be fixed to an external surface of plurality of dividers 14. However, it should be appreciated that a preferred configuration of fastener 40 would include body 41 being internally embedded within an internal divider such that only prongs 42 are protruding from an external surface of an individual internal divider. By positioning the body 41 of fastener 40 within an internal divider, fastener 40 would be less prone to damage and potential removal from extended use of expansion folder 100, whereas fastener 40 that has body 41 secured to an external surface of an internal divider could be forcibly, or accidentally, removed.

Figure 5:
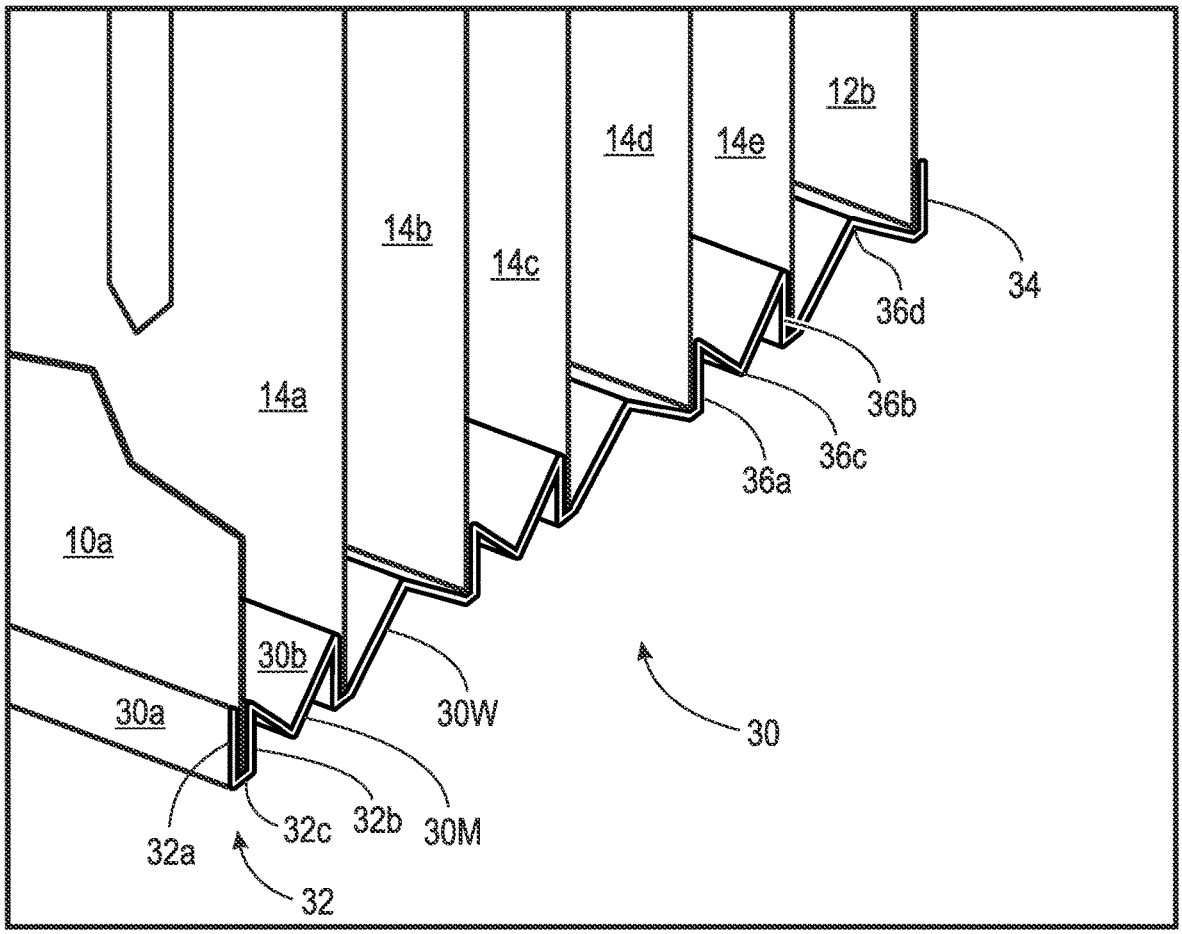
FIG. 5 illustrates a focused perspective view of section 5 shown in FIG. 4, specially highlighting the accordion-pleated spline.

FIG. 5 illustrates a focused perspective view of section 5, shown in FIG. 4. Accordion-pleated spline 30 comprises a plurality of M-shaped pleats 30M and W-shaped pleats 30W which alternate configuration in adjacent pleats along accordion-pleated spline 30. M-shaped pleats 30M each comprise valley 36*c* which is a fold. W-shaped pleats 30W each comprise peak 36*d* which is a fold. Accordion-pleated spline 30 has external surface 30*a* and internal surface 30*b*. Plurality of internal dividers 14, as shown in the preceding figures, includes individual internal dividers 14*a*-14*e*, whereas each internal divider comprises two external surfaces which may also be referred to as a forward-facing surface and a rear-facing surface, specifically where a forward-facing surface is in the direction towards front cover 10 and where a rear-facing surface is in the direction towards rear cover 12. Although FIG. 5 only shows internal dividers 14*a*-14*e*, it should be appreciated that any suitable number of internal dividers may be acceptable in accordance with the configuration of M-shaped pleats 30M and W-shaped pleats 30W of accordion-pleated spline 30. M-shaped pleats 30M comprise first leg 36*a*, second leg 36*b*, and valley 36*c*. W-shaped pleats 30W comprise first leg 36*a*, second leg 36*b*, and peak 36*d*. It should be appreciated that M-shaped pleat 30M first leg 36*a* is also a shared leg of W-shaped pleat 30W, while second leg 36*b* of M-shaped pleat 30M is also a shared leg of a subsequent W-shaped pleat 30W that follows M-shaped pleat 30M, as shown in FIG. 5.

Hereinafter, the following description references M-shaped pleats 30M and W-shaped pleats 30W in numerical order, where the "first" M-shaped pleat 30M is closest to front cover 10 and the "first" W-shaped pleat 30W is also closest to front cover 10, ascending in order ("second", "third", . . . ) the closer the M-shaped pleats 30M and W-shaped pleats 30W are in relation to rear cover 12. Internal dividers 14*a*-14*e* are specifically fixed to accordion-pleated spline. The forward-facing surface of internal divider 14*a* is fixed to an outside surface of second leg 36*b* of first M-shaped pleat 30M, which is also internal surface 30*b* of accordion-pleated spline 30. Alternatively, it could be said that the forward-facing surface of internal divider 14*a* is fixed to an inside surface of second leg 36*b* of first W-shaped pleat 30W, which is also internal surface 30*b* of accordion-pleated spline 30. The rear-facing surface of internal divider 14*b* is fixed to an inside surface of first leg 36*a* of first W-shaped pleat 30W, which is also internal surface 30*b* of accordion-pleated spline 30. Alternatively, it could be said that the rear-facing surface of internal divider 14*b* is fixed to an outside surface of first leg 36*a* of second M-shaped pleat 30M, which is also internal surface 30*b* of accordion-pleated spline 30. The forward-facing surface of internal divider 14*c* is fixed to an outside surface of second leg 36*b* of second M-shaped pleat 30M, which is also internal surface 30*b* of accordion-pleated spline 30. Alternatively, it could be said that the forward-facing surface of internal divider 14*c* is fixed to an inside surface of second leg 36*b* of second W-shaped 30W, which is also internal surface 30*b* of accordion-pleated spline 30. The rear-facing surface of internal divider 14*d* is fixed to an inside surface of first leg 36*a* of second W-shaped pleat 30W, which is also internal surface 30*b* of accordion-pleated spline 30. Alternatively, it could be said that the rear-facing surface of internal divider 14*d* is fixed to an outside surface of first leg 36*a* of third M-shaped pleat 30M, which is also internal surface 30*b* of accordion-pleated spline 30. The forward-facing surface of internal divider 14*e* is fixed to an outside surface of second leg 36*b* of third M-shaped pleat 30M, which is also inwardly facing surface 30*b* of accordion-pleated spline 30. Alternatively, it could be said that the forward-facing surface of internal divider 14*a* is fixed to an inside surface of second leg 36*b* of third W-shaped pleat 30W, which is also internal surface 30*b* of accordion-pleated spline 30.

The plurality of M-shaped pleats 30M follow the configuration set forth above, except for first M-shaped pleat 30M that is located closest to front cover 10, which comprises additional material from accordion-pleated spline 30. The additional material is front cover securing tab 32 of accordion-pleated spline 30 that includes outside flap 32*a* and inside flap 32*b* which secure to outwardly facing surface 10*a* and inwardly facing surface 10*b* of front cover 10, respectively. Fold 32*c* of accordion-pleated spline 30 covers a bottom surface of front cover 10. Fold 32*c* of accordion-pleated spline 30 functions to provide additional protection to the bottom edge of front cover 10. Front cover 10 is secured to accordion-pleated spline 30 on its outwardly facing surface 10*a* via outside flap 32*a* and on its inwardly facing surface 10*b* via inside flap 32*b*, as shown in FIG. 5. It should also be appreciated that first M-shaped pleat 30M has a first leg and a second leg, where inside flap 32*b* is the first leg of M-shaped pleat 30M.

The plurality of W-shaped pleats 30W follow the configuration as set forth supra, except for the last W-shaped pleat 30W that is located closest to rear cover 12 where rear flap 34 of accordion-pleated spline 30 is the terminal end of spline 30. Rear flap 34 is arranged to secure to outwardly facing surface 12*a* of rear cover 12. Rear flap 34 is also the first leg of last W-shaped pleat 30W.

Figure 6:
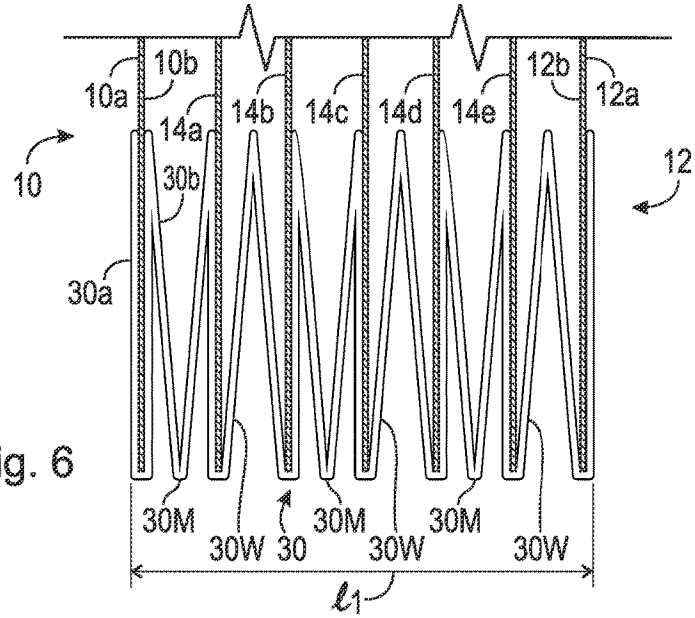
FIG. 6 illustrates a right-side view of the present invention shown in FIG. 1, specifically in a closed position; and, FIG. 7 illustrates a right-side view of the present invention shown in FIG. 6, specifically in an expanded position.
Figure 7:
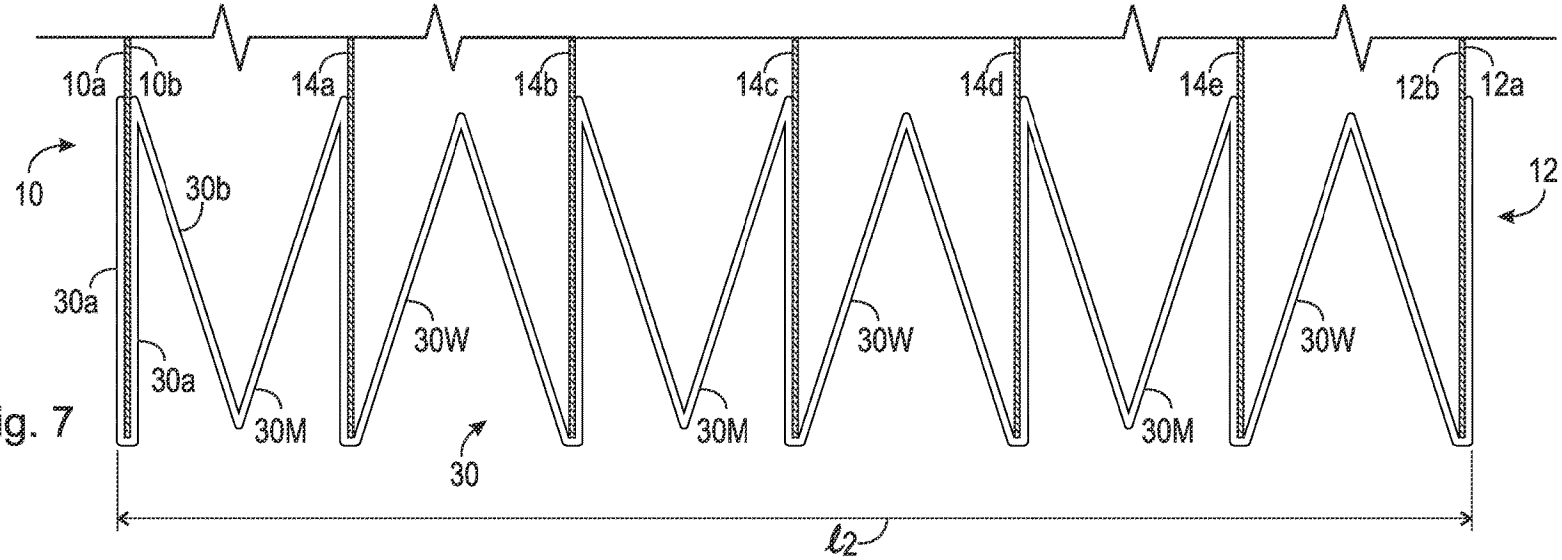

The following description should be taken in view of the preceeding figures along with FIGS. 6 and 7. FIG. 6 illustrates a right-side view of expansion folder 100 in a closed position without brackets 20, 22 affixed thereto, while FIG. 7 illustrates a right-side view of expansion folder 100 in an expanded position. Front cover 10 comprises forward facing surface 10*a* and rear facing surface 10*b*. Back cover 12 comprises forward facing surface 12*a* and rear facing surface 12*b*. It should be appreciated that forward facing is externally facing (away from the internal dividers 14*a*-14*e*) and rear facing is internally facing (towards internal dividers 14*a*-14*e*), as shown in FIGS. 6 and 7. Accordion-pleated spline 30 comprises external surface 30*a*, internal surface 30*b*, M-shaped pleats 30M and W-shaped pleats 30W. Closed length $l_1$ of accordion-pleated spline 30 of folder 100 (shown in FIG. 6) is approximately ⅜ of an inch in a closed position, whereas expanded length $l_2$ of accordion-pleated spline 30 of folder 100 (shown in FIG. 7) is approximately 9⅝ inches in an expanded position. Expanded length $l_2$ of accordion-pleated spline 30 is approximately 2465% greater than closed length $l_1$. It should be appreciated however that the closed length $l_1$ and expanded length $l_2$ of accordion-pleated spline 30 are only exemplary and correlate to accordion-pleated spline 30 that comprises three M-shaped pleats 30M and three W-shaped pleats 30W. In an alterative embodiment, which may have two or four M-shaped pleats 30M and two or four W-shaped pleats 30W, closed length $l_1$ and expanded length $l_2$ will increase or decrease depending on the number of M-shaped pleats 30M and W-shaped pleats 30W but the percentage increase in length $l_2$ in relation to closed length $l_1$ will remain approximately 2467%. For example, folder 100 that is configured with two M-shaped pleats and two W-shaped pleats would be approximately ¼ of an inch in a closed configuration and approximately 6.4167 inches in an expanded position, approximately a 2467% in increase in length from a closed position.

The following description should be taken in view of FIGS. 1-7, as described and set forth supra. In a preferred embodiment accordion-pleated spline 30 is comprised of a molded polymer that affords a rigid construction. The polymer construction of accordion-pleated spline 30 affords a thin construction of spline 30 that is approximately 0.007 inches in thickness. The polymer construction of spline 30 allows for its shape to be preserved for the life of folder 100, unlike prior art expansion splines that are comprised of cambric or Tyvek® material.

Front cover 10 and rear cover 12 in a preferred embodiment are comprised of solid paperboard that is coated in a laminate. The combination of solid paperboard construction and a laminate coating provide a resistive layer that prevents front cover 10 and rear cover 12 from fraying, delamination, and/or curling corners.

Fasteners 40, as described supra, may also be included as pairs in each respective internal divider. When an internal divider may comprise a pair of fasteners 40, body 41 of a first fastener 40 is heat embedded to the back of body 41 of an adjacent fastener 40 within an individual internal divider. Body 41 of fastener 40 and an adjacent body 41 of an adjacent fastener 40 that are fixed to each other, are embedded within an individual internal divider such that prongs 42 of fastener 40 are exposed on a forward-facing surface of an individual internal divider and that prongs 42 of an adjacent fastener 40 are exposed on a rear-facing surface of the same individual internal divider. Additionally, each of plurality of internal dividers 14 in a preferred embodiment are comprised of 17 pt hardwood natural Kraft paper.

Although the configuration of accordion-pleated spline 30 is described to have alternating M-shaped pleats 30M and W-shaped pleats 30W such that M-shaped pleats 30M and W-shaped pleats 30W are in a one-to-one ratio, it can be contemplated that an alterative configuration of accordion-pleated spline 30 may be contemplated where that last pleat of spline 30 would be M-shaped pleat 30M as opposed to W-shaped pleat 30W. For example, an ending M-shaped pleat 30M would comprise a rear flap that would be identical to front flap 32 arranged to secure rear cover 12 in the same manner that front flap 32 secures front cover 10 to spline 30, as shown in FIG. 5.

Thus, it is seen that the objects of the invention are efficiently obtained, although modifications and changes to the invention may be readily imagined by those having ordinary skill in the art, and these changes and modifications are intended to be within the scope of the claims.

REFERENCE NUMBERS

10 Front cover
10*a* Outwardly facing surface of front cover 10
10*b* Inwardly facing surface of front cover 10
12 Rear cover
12*a* Outwardly facing surface of rear cover 12
12*b* Inwardly facing surface of rear cover 12
14 Plurality of inner dividers
14*a* First internal divider of plurality of inner dividers 14
14*b* Second internal divider of plurality of inner dividers 14
14*c* Third internal divider of plurality of inner dividers 14
14*d* Fourth internal divider of plurality of inner dividers 14
14*e* Fifth internal divider of plurality of inner dividers 14
20 First bracket
22 Second bracket
30 Accordion-pleated spline
30*a* External surface of accordion-pleated spline 30
30*b* Internal surface of accordion-pleated spline 30
30M M-shaped pleat of accordion-pleated spline 30
30W W-shaped pleat of accordion-pleated spline 30
32 Front cover securing tab 32 of accordion-pleated spline 30
32*a* Outside flap of front securing tab 32
32*b* Inside flap of front securing tab 32
32*c* Fold of front securing flap 32
34 Rear flap of accordion-pleated spline 30
36*a* first leg of M-shaped pleat 30M or W-shaped pleat 30W
36*b* second leg of M-shaped pleat 30M or W-shaped pleat 30W
36*c* valley of M-shaped pleat 30M
36*d* peak of W-shaped pleat 30W
40 Fastener
41 Body of fastener 40
42 Pair of prongs of fastener 40
100 Expansion folder

What is claimed is:

1. An expansion folder with internal dividers, said folder having an accordion-pleated spline, said folder comprising:

a front cover, said front cover comprising an outwardly facing surface and an inwardly facing surface;

a rear cover, said rear cover comprising an outwardly facing surface and an inwardly facing surface;

a plurality of dividers, each of said plurality of dividers comprising a front-facing surface and a rear-facing surface; and, an accordion-pleated spline, said spline comprising a polymer formed into a plurality of pleats, said pleats further comprising an alternating series of "M-shaped" and "W-shaped" pleats, wherein a single internal surface of one of said M-shaped pleats is fixedly secured to said outwardly facing surface of said front cover, a single internal surface and a single external surface of one of said W-shaped pleat is fixedly secured to said inwardly facing surface of said rear cover and said outwardly facing surface of said rear cover, respectively, and one and only one internal surface of one of said M-shaped pleats or one and only one external surface of said W-shaped pleats is secured to either said front-facing surface or said rear-facing surface of one of each of said plurality of dividers.

2. The expansion folder with internal dividers with an accordion-pleated spline recited in claim 1, wherein said accordion-pleated spline further comprises an internal surface and an outer surface.

3. The expansion folder with internal dividers with an accordion-pleated spline recited in claim 2, wherein at least one clamp is operatively arranged to accept said outwardly facing surface of said front cover, said outwardly facing surface of said rear cover, and a plurality of pleats on said outer surface of said accordion-pleated spline.

4. The expansion folder with internal dividers with an accordion-pleated spline recited in claim 3, wherein said front cover is comprised of solid paperboard.

5. The expansion folder with internal dividers with an accordion-pleated spline recited in claim 4, wherein said rear cover is comprised of solid paperboard.

6. The expansion folder with internal dividers with an accordion-pleated spline recited in claim 5, wherein each of said plurality of dividers is comprised of 17 pt hardwood natural Kraft.

7. The expansion folder with internal dividers with an accordion-pleated spline recited in claim 1, wherein said plurality of dividers have two external surfaces, each of said plurality of dividers may include a fastener, said fastener comprises a body and a pair of prongs extending therefrom, wherein said body of said fastener is heat embedded within each of said plurality of dividers and said prongs extend from one of said outer surfaces of each of said plurality of dividers.

8. The expansion folder with internal dividers with an accordion-pleated spline recited in claim 1 is further arranged to configure into a closed position and an open position, wherein a width of said open position is approximately 2467% greater than a width of said closed position.

9. The expansion folder with internal dividers with an accordion-pleated spline recited in claim 1, wherein said internal dividers are arranged to expand to approximately ¾" between an adjacent internal divider.

10. An expansion folder with internal dividers, said folder having an accordion-pleated spline, said folder comprising:

a front cover, said front cover comprising an outwardly facing surface and an inwardly facing surface;

a rear cover, said rear cover comprising an outwardly facing surface and an inwardly facing surface;

a plurality of dividers, each of said plurality of dividers comprising a front-facing surface and a rear-facing surface;

an accordion-pleated spline, said spline comprising a polymer formed into a plurality of pleats, said pleats further comprising an alternating series of "M-shaped" and "W-shaped" pleats, wherein a single internal surface of one of said M-shaped pleats is fixedly secured to said outwardly facing surface of said front cover, a single internal surface and a single external surface of one of said W-shaped pleat is fixedly secured to said inwardly facing surface of said rear cover and said outwardly facing surface of said rear cover, respectively, and one and only one internal surface of one of said M-shaped pleats or one and only one external surface of said W-shaped pleats is secured to either said front-facing surface or said rear-facing surface of one of each of said plurality of dividers; and, at least one fastener arranged to clamp said outwardly facing surface of said front cover and said outwardly facing surface of said rear cover.

11. The expansion folder with internal dividers with an accordion-pleated spline recited in claim 10 is further arranged to configure into a closed position and an open position, wherein a width of said open position is approximately 2467% greater than a width of said closed position.

12. The expansion folder with internal dividers with an accordion-pleated spline recited in claim 10, wherein said plurality of dividers have two external surfaces, each of said plurality of dividers may include a fastener, said fastener comprises a body and a pair of prongs extending therefrom, wherein said body of said fastener is heat embedded within each of said plurality of dividers and said prongs extend from one of said outer surfaces of each of said plurality of dividers.

13. The expansion folder with internal dividers with an accordion-pleated spline recited in claim 10, wherein said front cover is comprised of solid paperboard.

14. The expansion folder with internal dividers with an accordion-pleated spline recited in claim 13, wherein said rear cover is comprised of solid paperboard.

15. The expansion folder with internal dividers with an accordion-pleated spline recited in claim 14, wherein each of said plurality of dividers is comprised of 17 pt hardwood natural Kraft paper.

16. The expansion folder with internal dividers with an accordion-pleated spline recited in claim 1, wherein said front cover and said rear cover are coated in a laminate.

17. The expansion folder with internal dividers with an accordion-pleated spline recited in claim 14, wherein said front cover and said rear cover are coated in a laminate.

* * * * *